United States Patent [19]

Fisher et al.

[11] 4,294,686

[45] Oct. 13, 1981

[54] PROCESS FOR UPGRADING HEAVY HYDROCARBONACEOUS OILS

[75] Inventors: Ian P. Fisher, Oakville; H. John Woods, Campbellville; Frank Souhrada, Weston, all of Canada

[73] Assignee: Gulf Canada Limited, Toronto, Canada

[21] Appl. No.: 129,288

[22] Filed: Mar. 11, 1980

[51] Int. Cl.[3] ..... C10G 45/28; C10G 47/34

[52] U.S. Cl. ..... 208/56; 208/58

[58] Field of Search ..... 208/56, 58

[56] References Cited

U.S. PATENT DOCUMENTS

| | | | |
|---|---|---|---|
| 2,467,920 | 4/1949 | Voge | 208/56 |
| 2,620,293 | 12/1952 | Blue | 208/56 |
| 2,843,530 | 7/1958 | Langer, Jr. | 208/56 |
| 2,873,245 | 2/1959 | Thompson | 208/56 |
| 2,953,513 | 9/1960 | Langer, Jr. | 208/56 |
| 3,730,875 | 5/1973 | Gleim | 208/56 |

*Primary Examiner*—T. M. Tufariello

*Attorney, Agent, or Firm*—D. R. Morrison

[57] ABSTRACT

An integrated upgrading process is disclosed which can be used to lower the specific gravity, viscosity and boiling range of heavy, viscous hydrocarbonaceous oil by means of fractionally distilling the oil, treating its residuum with a hydrogen donor material under hydrocracking conditions, fractionally distilling the effluent from the hydrocracking zone and rehydrogenating that portion boiling from about 180° C. to 350° C. for recycling to the hydrocracking zone. The liquid portion of the oil not recycled can be recombined into a reconstituted crude suitable for transporting by normal crude pipelines.

13 Claims, 4 Drawing Figures

PROCESS FOR UPGRADING HEAVY HYDROCARBONACEOUS OILS

FIELD OF THE INVENTION

This invention relates to a process for improving the quality of heavy, viscous crude oils. More specifically, it relates to a process comprising separating the viscous crude into fractions by fractional distillation, and cracking and hydrogenating the highest boiling fraction so obtained in the presence of a recycled hydrogen donor material obtained by separating particular portions of the resulting cracked material and catalytically rehydrogenating a specific portion so produced to prepare said hydrogen donor material for recycling. The fractionated streams produced in separating said viscous crude and in separating said hydrogenated cracked material are suitable for further hydrogenation and/or recombining into a reconstituted crude oil, or for use in normal refinery processes without being recombined.

DESCRIPTION OF THE PRIOR ART

The properties of heavy crudes, i.e. in-situ heavy oils and oil sands bitumen, have long been known. These materials are abundant in Canada and several other countries and are of increasing importance as conventional, i.e. lighter, crude oils are depleted. Among the properties of these materials are a low hydrogen:carbon ratio, high viscosity, and a high proportion of components which cannot be vacuum distilled without undergoing thermal cracking. As a result, these heavy oils are impossible to transport through normal crude pipelines or to process in existing refineries. The prior art has shown that (1) carbon rejection, i.e. coking, and (2) hydrogen addition are the two basic approaches to be used in upgrading such crude oils. The term "upgrading" can take various meanings in various contexts. For clarity and consistency, it is here defined as raising the hydrogen:carbon ratio, and lowering the viscosity, specific gravity and average molecular weight of a heavy, viscous hydrocarbonaceous oil. Carbon rejection has the disadvantage of producing a large quantity of refractory materials such as coke which then must be disposed of and which detract from the total amount of liquid product available. Hydrogenation on the other hand produces a larger quantity of valuable liquid products and is more desirable than carbon rejection if the hydrogenation can be carried out at reasonable cost.

Hydrogen donor materials are well known for their ability to release hydrogen to a hydrogen-deficient oil in a thermal cracking zone, and thereby to convert heavy hydrocarbon oils to more valuable lower-boiling products. The hydrogen donor is aromatic-naphthenic in nature and, having released hydrogen in the thermal cracking zone, can be catalytically rehydrogenated in a separate hydrogenation zone and recycled as a hydrogen donor. Hydrogen donor cracking processes make possible the conversion of heavy oils in the absence of a catalyst and with the formation of little, if any, coke, and at substantially lower pressures than are necessary with the use of molecular hydrogen in hydrocracking.

In U.S. Pat. No. 2,953,513 it was disclosed that certain distillate thermal tars, boiling above 371° C., will, upon partial hydrogenation, produce a hydrogen donor material which can be used to hydrocrack heavy feedstocks at temperatures above 427° C. The hydrogen donor material can be rehydrogenated using external hydrogen and recycled to the thermal cracking stage(s).

In U.S. Pat. No. 4,115,246 a process was disclosed in which the pitch fraction resulting from fractional distillation of the products of a hydrogen donor diluent cracking step is subjected to a partial oxidation process, and the resulting hydrogen-containing gas produced by the partial oxidation step is utilized to hydrogenate the recycled hydrogen donor solvent. The pitch fraction was defined as the product of the fractional distillation boiling above 500° C. It was disclosed that the fresh feedstock to the cracking furnace could include shale oil, tar sand bitumen, or residual oil from a petroleum refinery.

Many of the processes known in the art are designed for application in a conventional petroleum refinery; these processes do not address the problem of transporting the crude oil from the well site to the refinery. The coking processes in general form excessive amounts of coke, which must be discarded or desulphurized and burned, and which lower the yield of useful hydrocarbons. In those processes in which catalysts are used, metals present in the crude have a tendency to poison the catalyst and create the necessity for frequent regeneration or replacement of the catalyst.

In the ensuing description and claims, all references to proportions, percentages, and parts are on a weight basis and all references to boiling points of materials are to atmospheric pressure boiling points, unless otherwise specifically indicated.

SUMMARY OF THE INVENTION

The present invention is a process for the upgrading of heavy, viscous hydrocarbonaceous oils comprising:

(a) fractionally distilling said hydrocarbonaceous oil to produce at least one fraction boiling below a temperature from substantially 300° C. to substantially 570° C. and a residuum boiling above said temperature, without significantly cracking said hydrocarbonaceous oil, (b) contacting said residuum with a liquid hydrogen donor material stream at hydrocracking conditions to produce a hydrocracked stream, (c) separating said hydrocracked stream into a gaseous stream and a liquid hydrocracked stream, (d) fractionally distilling said liquid hydrocracked stream to separate, from lower and higher boiling fractions, a hydrogen donor precursor stream boiling above a temperature from substantially 180° C. to substantially 200° C. and below a temperature from substantially 330° C. to substantially 350° C., (e) catalytically reacting said hydrogen donor precursor stream with a hydrogen-rich gaseous stream to produce a hydrogenated hydrogen donor material, and (f) at least part of recycling, said hydrogenated hydrogen donor material as the material which constitutes the entire liquid hydrogen donor material stream to contact said residuum in step (b) noted above.

In a specific embodiment, the invention comprises steps (a) to (f) noted above, wherein fractional distillation step (a) is carried out to produce a naphtha stream, a distillate stream and a gas oil stream as well as the aforementioned residuum, and the lower and higher boiling fractions from fractional distillation step (d) are utilized as follows: the overhead stream is combined with said naphtha stream from step (a), a heavy gas oil stream is combined with said gas oil stream from step (a) and these streams as well as a bottoms stream from step (d) are withdrawn as product streams.

Optionally, the gaseous stream obtained at step (c) can be desulphurized to produce a desulphurized gaseous stream, and said desulphurized gaseous stream can be reformed with stream to form a hydrogen-rich gaseous stream for use in step (e) and by-product carbon dioxide. Alternatively, where an external supply of methane-rich gas (e.g. natural gas) is advantageously available, the gaseous stream from step (c) can be used as fuel gas and the external supply of methane-rich gas can be utilized as the source of hydrogen for the reforming step.

Preferably, the aforementioned hydrogenated hydrogen donor material stream is fractionally distilled to separate, from lower and higher boiling materials, an optimized hydrogenated hydrogen donor material, which lower and higher boiling materials are combined with the appropriate product stream or streams.

Optionally, where it is desirable, said product streams can individually be catalytically reacted with a hydrogen-rich gas, to produce more fully upgraded streams which can be used in a conventional oil refinery, or alternatively they can be combined with the bottoms stream from step (d) to produce a fully upgraded, lower viscosity synthetic crude.

APPLICABILITY OF THE INVENTION

The process of the invention is applicable to upgrading various types of heavy crudes, including in-situ heavy oils (e.g. Lloydminster), oil sands bitumen (e.g. Athabasca), and generally any type of crude oil whose composition and viscosity in the raw form are such that they render it difficult or impossible to process the oil in a conventional oil refinery or to transport in a pipeline without dilution or external heating or tracing of the pipeline and consequent large-scale waste of energy.

BRIEF DESCRIPTION OF THE DRAWINGS

In drawings which illustrate an embodiment of the invention and variations.

DETAILED DESCRIPTION

Figure 1:
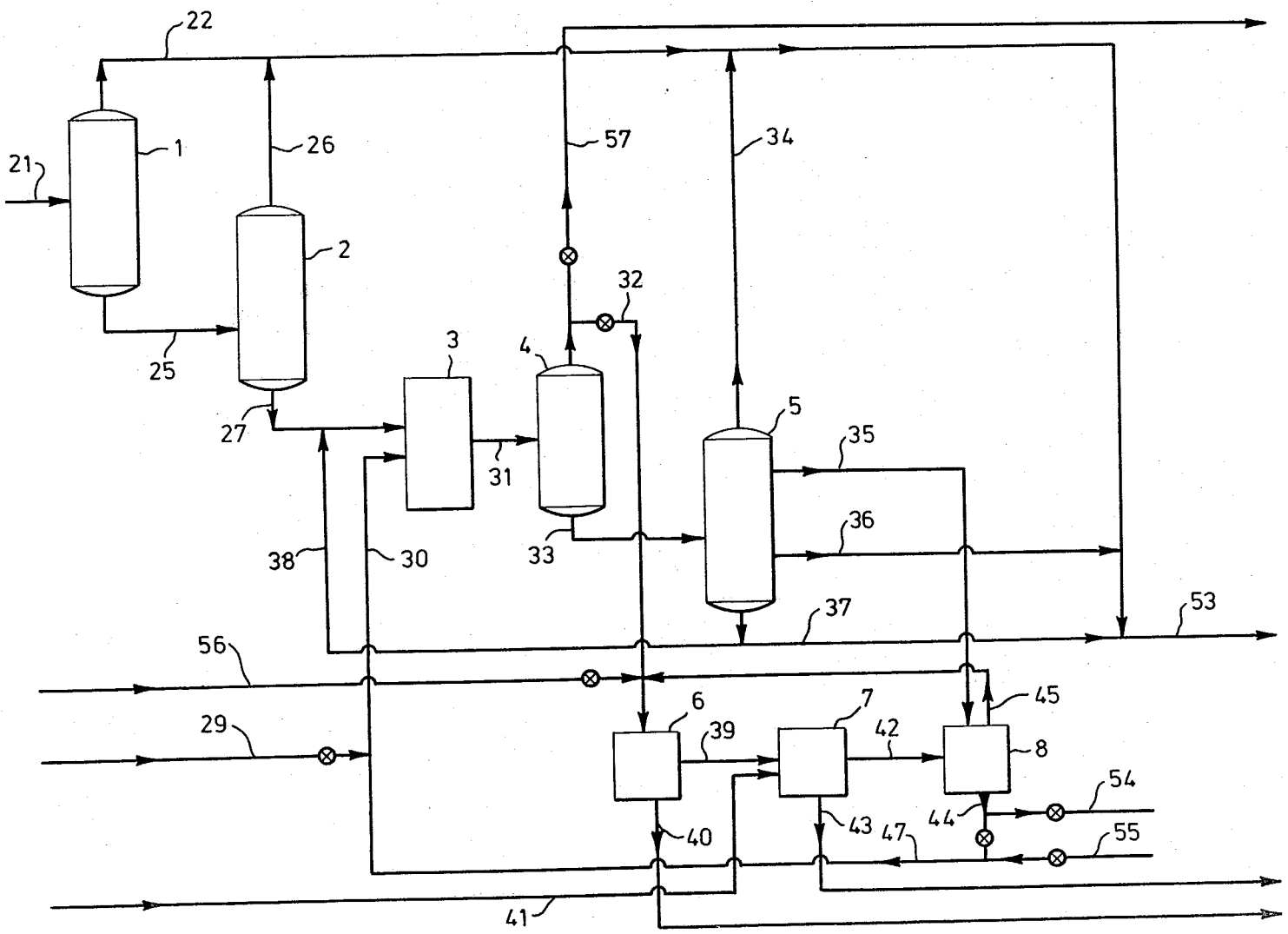
FIG. 1 is a schematic flow sheet illustrating the basic process of the invention.

Referring to FIG. 1, raw crude oil in stream 21 is distilled to remove material distillable without thermal cracking. In order to avoid unwanted cracking and coking in distilling the more refractory components of the mixture, the distillation is preferably carried out in two stages, the first at atmospheric pressure in fractionating column 1 with overheads going via line 22 and residue via line 25, and the second under vacuum in fractionating column 2, from which overheads go via line 26 and residue or bottoms via 27. The amount of absolute pressure in column 2 can be varied to as low as 2 kPa but is normally selected for minimum steam usage, and commercial operations are commonly conducted at 2.5–4 kPa. The bottoms stream from vacuum distillation step 2 can have an initial boiling point varying over a wide range, depending upon the type of crude and process conditions. Bottoms with an initial boiling point as low as 300° C. or as high as 570° C., preferrably in the range from 450° C. to 570° C., can be used in the process, although for reasons of economics it may be advantageous to remove as much distillate material as possible to reduce the volume of reaction mixture and consequently the size and cost of a hydrogen donor cracking zone 3. Under some circumstances, for example in the use of a small upgrading plant (1500–3000 $m^3$/day), it may be desirable to omit a vacuum tower for crude fractionation and thus to feed to hydrogen donor cracking zone 3 a bottoms stream having an initial boiling point in the range associated with atmospheric tower bottoms, 300° C. to 330° C. The bottoms stream 27 is contacted in reactor 3 with a hydrogenated recycled stream 30. An initial supply of hydrogen donor material for start-up is fed through line 29 until adquate flow in stream 30 is established. The recycled stream has the ability to donate hydrogen and is used in a weight ratio of substantially 1:0.5 to 1:4 and a temperature of substantially 350° C. to 500° C., preferably 400° C. to 460° C. and at an absolute pressure of substantially 2 to 15 MPa, preferably 2.5 to 6 MPa, and a reaction mass liquid space velocity of substantially 0.5 to 10.0 $h^{-1}$, preferably 0.8 to 7.0 $h^{-1}$. No catalyst is necessary in the hydrogen donor cracking reaction. Under the preferred conditions no coke is produced in the reaction. Effluent from reactor 3 passes via line 31 to gas separator 4, which separates gases including hydrocarbons boiling at ambient room temperature or lower. Alternatively and particularly advantageously, gaseous material in stream 32 is treated to remove hydrogen sulphide in desulphurization zone 6 and is passed via line 39 into a steam reforming zone 7 along with external steam in stream 41, forming a hydrogen-rich gas passing via line 42 to be used in catalytic hydrogenation zone 8. Sulphur is removed from zone 6 via line 40 and carbon dioxide-rich gas from zone 7 is discharged via line 43. The liquid reactor effluent 33 from separator 4 is fractionated in fractionating still 5, and the distilled portion boiling for example from substantially 180° C. to substantially 350° C., preferably from 200° C. to 330° C., in stream 35, is rehydrogenated in catalytic hydrogenation zone 8. The upper and lower limits of the boiling range of stream 35 may be adjusted as necessary to obtain an appropriate volume of hydrogen donor material for stream 30. Overhead fractions 22, 26 and 34, gas oil fraction 36 and residuum fraction 37 can be combined into a reconstituted "crude" in stream 53 which has sufficiently low viscosity that it is suitable for pumping. A portion of residuum fraction 37 can optionally be recycled through line 38 to be combined with bottoms stream 27 and reprocessed through the hydrogen donor cracking zone. The reaction in hydrogenation zone 8 normally does not consume all the hydrogen from stream 42 and the unused gases which are contaminated with hydrogen sulphide can be recycled to the inlet of desulphurization zone 6, via line 45. During operation, the hydrogen donor capability of the fraction in stream 35 is sufficient, when the latter has undergone catalytic hydrogenation in zone 8, to continue the hydrogen donor cracking without adding make-up hydrogen donor material via line 29. The hydrogen-rich gas in stream 42 is used to hydrogenate the fraction in stream 35 under usual catalytic hydrogenation conditions in zone 8 and the effluent stream of liquid hydrogenated material 44 is passed either directly to line 47 thence to line 30 where it is recycled into hydrogen donor cracking zone 3, or via line 54 to a fractionation, hereafter described with reference to FIG. 3, and return of a fraction thereof via line 55 to line 47. The gaseous materials formed in the hydrocracking step and separated at step 4 include methane and other hydrocarbons having up to substantially five carbon atoms in their molecules. These latter materials have lower hydrogen-to-carbon ratios, hence may be more useful for their heating value than for their hydrogen content. It may, therefore, be advantageous to take these materials to fuel gas via line 57, and at the same time to utilize an external gas stream in the steam reforming step by importing it through line 56. The imported gas stream can be for example natural gas and can contain hydrogen; it is desulphurized if it is sour, in the desulphurization zone 6 as shown in FIG. 1, or taken directly to steam reforming zone 7, as appropriate. Similarly the gaseous stream 32 may be desulphurized if necessary in a desulphurization zone, or taken directly to product via line 57, as shown in FIG. 1.

An optional source of hydrogen for use in hydrogenating zone 8 is the steam reforming of a residuum in steam reforming zone 7, instead of reforming the gaseous material separated at step 4. An advantageous source of residuum for this purpose is stream 37, the bottoms from fractionation step 5.

Suitable hydrogen donor or hydrogen donor precursor material for starting up the process can be obtained for example, in certain refinery streams known in the art. If necessary or desirable, it can be hydrogenated in the described hydrogenation zone 8 prior to contacting with fractionating tower bottoms stream 27 in hydrogen donor cracking zone 3.

Figure 2:
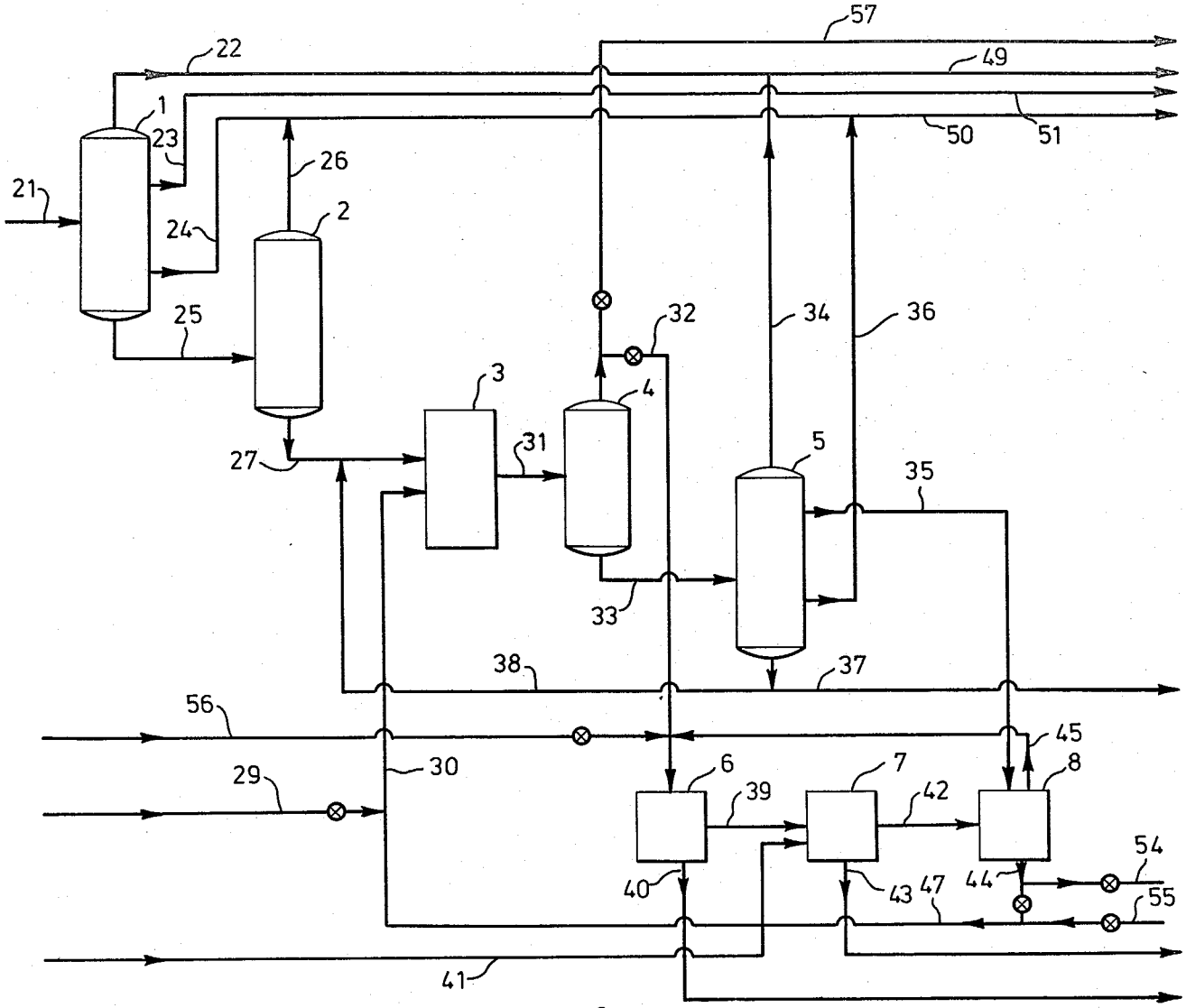
FIG. 2 is a schematic flow sheet showing a specific group of fractionated streams.

FIG. 2, employing identical numbers for parts identical to those shown in FIG. 1, illustrates an optional processing scheme wherein the initial crude 21 is fractionally distilled into a plurality of cuts 22, 23 and 24 each of whose initial and final boiling points can be selected as is customary in petroleum refining to produce appropriate streams. Commonly used fractions are naphtha, distillate and gas oil, although fewer or more than three fractions can be taken without departing from the scope of the invention. The fractions resulting from the distillation step 5 in streams 34 and 36 can be combined with the appropriate fractions from the crude distillation, i.e. fractions of similar boiling ranges, to obtain a plurality of product streams 49, 51 and 50. At the same time the bottoms stream 37 from fractional distillation step 5 can be kept as a separate product stream.

Figure 3:
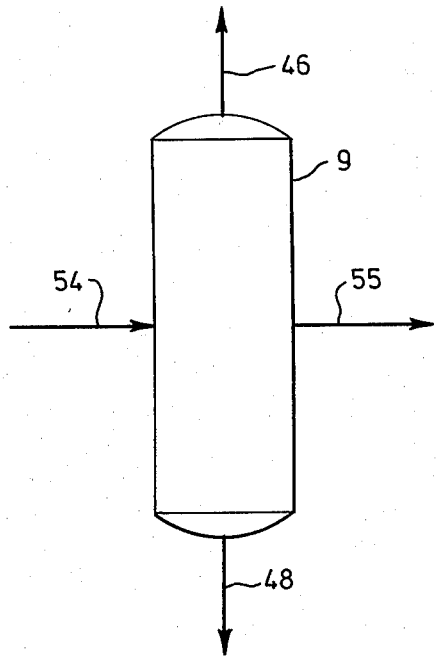
FIG. 3 is a schematic flow sheet showing a more complex process of obtaining an optimum recycled hydrogen donor material.

Referring to FIG. 3, which is to be considered in conjunction with the embodiments of either FIG. 1 or FIG. 2, the hydrogenated hydrogen donor material in stream 44 from zone 8 optionally can be passed via line 54 and fractionally distilled in distillation column 9 to separate, from lower and higher boiling materials 46 and 48, a hydrogen donor heart cut 55, boiling for example in the range from substantially 220° C. to substantially 295° C., which can be fed through line 47 to hydrogen donor cracking zone 3. The lower boiling material 46 can be combined for example with naphtha stream 49 and the higher boiling material 48 combined for example with gas oil stream 50 (FIG. 2), or if desired, both can be combined with the product stream 53 (FIG. 1). The hydrogen donor activity of the lower boiling and higher boiling streams 46 and 48 is lower than that of the heart cut 55 and their removal has the effect of raising the concentration of active hydrogen donor material recycled to the hydrogen donor cracking zone 3.

Figure 4:
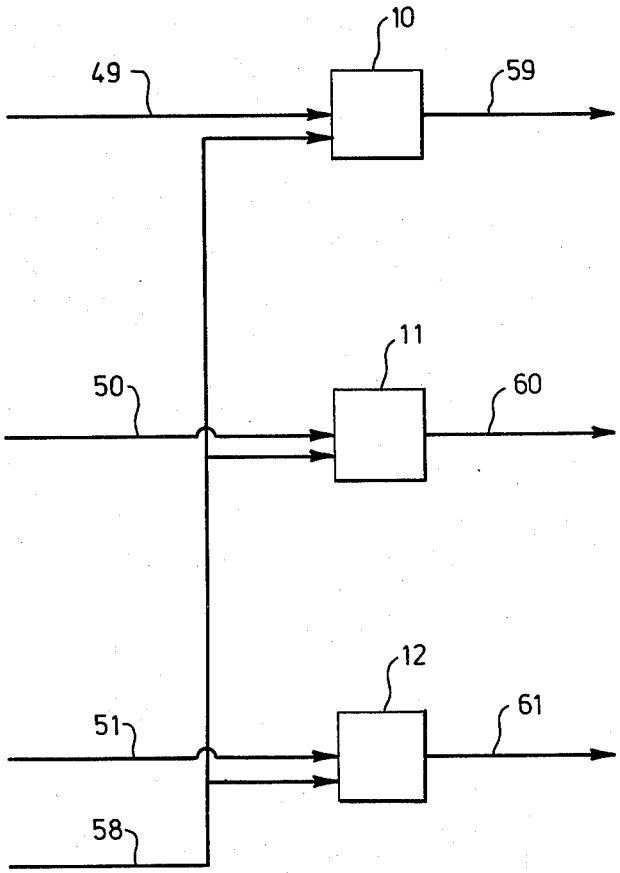
FIG. 4 is a schematic flow sheet showing a further treatment of the streams shown in FIG. 2.

A modification of the embodiments of the invention outlined in FIGS. 1 and 2 is shown in FIG. 4. The reconstituted naphtha, distillate and gas oil streams 49, 50 and 51, obtained as shown in FIG. 2, can optionally be further hydrogenated individually at catalytic hydrogenation steps 10, 11 and 12 by known methods. A hydrogen-rich gas can be introduced from an external source via line 58 and the resulting hydrogenated naphtha stream 59, hydrogenated distillate stream 60 and hydrogenated gas oil stream 61 are therefore suitable for direct use in a conventional oil refinery. Alternatively these hydrogenated streams can be combined with the residuum stream 37 (FIG. 1) to obtain in stream 53 an upgraded, lower viscosity pipelineable synthetic crude oil suitable for use in conventional oil refineries remote from the upgrading plant. Because of its higher hydrogen:carbon ratio, the synthetic crude oil can give higher quality products with less processing than less highly hydrogenated synthetic crude oils.

An advantage of the present process is that it can be used in a small production area to provide crude capable of being transported by pipeline to an appropriate refinery. A further advantage is that the process at proper operating conditions produces no coke. A still further advantage is that it uses as the hydrogen transfer material a fraction of the heavy crude that is generated in the process itself, and therefore no additional hydrogen transfer agent is needed after the initial start-up. Another advantage of this process is that it can convert as much as 90 percent of the high boiling components in the crude, i.e. components boiling at greater than about 504° C., to components boiling at less than about 504° C. Further, the products streams can be used in any of several optional ways, enabling the process to be tailored to actual field conditions.

EXAMPLE 1

A sample of 2000 parts by weight of raw bitumen, obtained by steam stimulation of a Pelican Lake (Alberta) heavy oil field, was submitted to distillation, first at atmospheric pressure then under reduced pressure so as to avoid any thermal cracking, to give a total overheads fraction (having a boiling range from its initial boiling point up to 491° C.) amounting to 998 parts and a vacuum residuum of 1002 parts having a boiling range above 491° C. In a two liter autoclave, 497 parts of the vacuum residuum was thoroughly blended with 497 parts of a hydrocarbon stream serving as an initial hydrogen donor stream. This donor stream was the heart cut obtained by hydrotreating a fluid catalytically cracked fraction that boiled in the range of 193° C. to 343° C. and fractionally distilling the hydrotreated material to obtain a heart cut boiling in the range 221° C. to 293° C.; the donor stream had a content of 48.7 percent by weight of benzocycloparaffins (predominantly substituted tetrahydronaphthalenes) and 19.4 percent naphthalenes, as determined by low resolution mass spectrometry. After sealing the autoclave, the air was displaced therefrom by nitrogen and a residual pressure of 0.65 MPa absolute left in the vessel. The vessel was then stirred and heated to an internal temperature of 415° C. at a rate of substantially 5.3° C. per minute and maintained at this temperature for a hydrogen donor cracking period of 81 minutes before cooling was begun. During this constant temperature period the pressure in the vessel increased from 3.0 MPa to 8.3 MPa. After cooling to ambient temperature (22° C., at which the pressure was 2.34 MPa) the gas was discharged from the autoclave and its volume measured (36.6 liters at NTP, including the nitrogen of the residual nitrogen pressure). The total evolved gas (nitrogen free basis) amounted to 4.6 percent by weight of the material charged to the autoclave; on analysis the gas was found to have a composition, on a nitrogen free basis, approximately as shown in Table 1.

TABLE 1

| Ingredient | Weight % |
|---|---|
| $H_2$ | 0.49 |
| CO | 0.52 |
| $H_2S$ | 23.66 |
| $CO_2$ | 0.87 |
| $CH_4$ | 16.80 |
| $C_2H_6$ | 19.36 |
| $C_3H_6$ | 0.88 |
| $C_3H_8$ | 19.54 |
| $C_4H_8$ (mixed) | 0.94 |
| $C_4H_{10}$ (mixed) | 11.01 |
| $C_5H_{10}$ (mixed) | 0.58 |
| $C_5H_{12}$ (mixed) | 3.84 |
| $C_6$ | 1.46 |

Upon desulphurization to remove the large proportion of hydrogen sulphide from this gas, it was eminently suitable, because of its high content of gaseous hydrocarbons, as the hydrocarbon feed to a steam reforming process for the production of the quantity of hydrogen utilized later in the process for catalytic rehydrogenation of a hydrocarbon fraction to form a hydrogen donor stream. There was no coke formation during the hydrogen donor cracking period and 952 parts of liquid product was recovered. Of this, 803 parts was fractionally distilled to yield three fractions, viz: (a) an initial fraction, having a boiling range up to 204° C. and amounting to 102 parts, (b) a mid-fraction having a boiling range from 204° C. to 316° C. and amounting to 421 parts, and (c) a residue boiling above 316° C. and amounting to 280 parts. A sample of this residue was further fractionated to separate material boiling above 491° C. and amounting to 54.5 percent by weight of the residue sample. It was thus calculated that 63.6 percent of the original vacuum residuum (all of which boiled above 491° C.) was converted to material with a boiling point below 491° C. The remainder of the 280 parts of (c) fraction noted above and an equivalent proportion of the overheads from the initial atmospheric and vacuum distillations were blended with an equivalent proportion of the 102 parts of (a) fraction noted above, to yield a reconstituted crude oil having improved properties with respect to sulphur content and specific gravity, and remarkably improved viscosity. A comparison of the properties of the raw bitumen and reconstituted crude is given in Table 2.

TABLE 2

| Property | Raw Bitumen | Reconstituted Crude |
|---|---|---|
| API Gravity | 11.1 | 19.3 |
| Specific Gravity | 0.9923 | 0.9381 |
| Viscosity, Centistokes | 1254.0 (at 37.8° C.) | 26.3 (at 40° C.) |
| Sulphur (Wt. %) | 5.3 | 4.5 |
| % Boiling above 491° C. | 50.1 | 19.0 |

The (b) fraction with a boiling range 204° C. to 316° C. from a duplicate operation as described above was rehydrogenated under catalytic hydrogenation conditions as follows. 459 parts of the fraction, and 50 parts of commercial hydrogenation catalyst designated as NT550 (supplied by Nalco Chemical Company) were sealed in a two liter autoclave, purged with nitrogen to remove air, then pressured with hydrogen to 5.62 MPa at 23° C. The stirred autoclave then was heated at a rate of 4.5° C. per minute until a temperature of 305° C. was reached. Pressure in the vessel rose to 9.33 MPa during heating. The temperature was maintained at 305° C. for the next 4.7 hours during which the autoclave was further repressured with hydrogen as recorded pressure readings indicated hydrogen was consumed by reaction with the fraction, to maintain a minimum pressure of 10.5 MPa, final hydrogenation pressure being 11.47 MPa. Heating was then stopped and the vessel allowed to cool to room temperature (23° C.). Pressure at this time was 4.42 MPa. The gas was discharged and on analysis was found to be predominantly hydrogen with some hydrogen sulphide and gaseous hydrogen. The hydrogenated liquid was recovered and found to amount to 452 parts by weight. Low resolution mass spectrometry of samples of the material, before and after rehydrogenation as described above, showed that the naphthalenes content decreased during hydrogenation from a value of 49.67 percent to 17.19 percent and the benzocycloparaffins content increased at the same time from 12.49 percent to 44.56 percent. Fractional distillation of the rehydrogenated material that would remove much of the more volatile fraction rich in saturated hydrocarbons (which constituted 19.04 percent of the rehydrogenated material) could lower the proportion of saturates and readily increase the benzocycloparaffins content to around 48 percent, which corresponds to that of the initial hydrogen donor stream. The rehydrogenated material, prepared as described above, was used as the hydrogen donor stream for blending with another sample of vacuum residuum of bitumen in the autoclave, as described at the beginning of this example, and was found effective, after a hydrogen donor cracking period as described above, to convert the residuum and form additional reconstituted crude of improved properties as described above.

EXAMPLE 2

A sample of hydrogen donor material, as was used in Example 1 and prepared by hydrogenating a light cycle oil obtained from a fluid catalytic cracking unit, was mixed in a 1:1 ratio with the residuum from a vacuum distillation of Athabasca oil sands bitumen. The residuum constituted 54.5 percent of the bitumen and had an initial boiling point of 505° C. The mixture was fed by a positive displacement pump at a rate of 598.8 g/hour into a tubular hydrogen donor cracking reactor of 989 ml volume and 22.9 m length, coiled into a helical shape and immersed in a fluidized sand bed maintained at constant temperature of 432° C. The reactor was equipped with a reciprocating mechanism to maintain turbulent flow conditions in the reactor, as disclosed in co-pending patent application Ser. No. 097,011 now U.S. Pat. No. 4,271,007. The reaction mixture, at 5.7 MPa, flowed through a pressure control valve downstream from the reactor tube and thence into a series of flash separation zones which separated the gaseous portion from the liquids portion of the reactor effluent. The flow rate of the gaseous stream was measured and the composition determined using an on-line gas chromatograph. The hydrocarbon content of the evolved gas was found to be sufficient to provide (by steam reforming) the hydrogen requirements for hydrogenation of the hydrogen donor precursor material separated from the liquids portion of the reactor effluent. The liquid portion of the reactor effluent was fractionally distilled to separate a fraction boiling in the range of 193° C. to 332° C. and amounting to 56.3% of the liquid products. This fraction was hydrogenated catalytically, over the same hydrogenation catalyst used in Example 1, at around 320° C. for 5.6 hours. Mass spectrometric analysis of samples of the fraction, before and after rehydrogenation, showed that, as in Example 1, the naphthalenes content decreased during hydrogenation and the benzocycloparaffins content increased as a result of the hydrogenation; the corresponding increase in hydrogen donor activity of the hydrogenated fraction and the quantity of the fraction together established that the fraction was adequate, on recycling in its entirety or as a concentrated distilled portion thereof to the reactor with fresh residuum, to maintain continuous operation of the hydrogen donor cracking reactor under the conditions initially used. The distillate from the distillation of the oil sands bitumen combined with the fractions from the remaining (43.7 percent) of the liquid reactor effluent not catalytically hydrogenated, constituted an upgraded hydrocarbonaceous oil that could be pumped through a pipeline in the manner used for normal crude oils.

Numerous modifications can be made in the various expedients described without departing from the scope of the invention which is defined in the following claims.

We claim:

1. A process for the upgrading of viscous hydrocarbonaceous oils comprising:

(a) fractionally distilling said hydrocarbonaceous oil to produce at least one fraction boiling below a temperature from substantially 300° C. to substantially 570° C. and a residuum boiling above said temperature, without significantly cracking said hydrocarbonaceous oil, (b) contacting said residuum with a liquid hydrogen donor material stream at hydrocracking conditions to produce a hydrocracked stream, (c) separating said hydrocracked stream into a gaseous stream and a liquid hydrocracked stream, (d) fractionally distilling said liquid hydrocracked stream to separate, from lower and higher boiling fractions, a hydrogen donor precursor stream boiling above a temperature from substantially 180° C. to substantially 200° C. and below a temperature from substantially 330° C. to substantially 350° C., (e) catalytically reacting said hydrogen donor precursor stream with a hydrogen-rich gaseous stream to produce a hydrogenated donor material, and (f) recycling at least part of said hydrogenated hydrogen donor material as the material which constitutes the entire liquid hydrogen donor material stream to contact said residuum in step (b) noted above.

2. A process as claimed in claim 1 in which the heavy viscous hydrocarbonaceous oil is heavy crude oil or oil sands bitumen.

3. A process as claimed in claim 1 in which the hydrocarbonaceous oil is initially distilled under atmospheric pressure to remove volatile material and then distilled under reduced pressure to leave a residuum with an initial boiling point in the range from 450° C. to 570° C.

4. A process as claimed in claim 1 in which the residuum is mixed with said recycled liquid hydrogen donor material stream in a weight ratio of from 0.5:1 to 4:1 under hydrocracking conditions.

5. A process as claimed in claim 1 in which said hydrocracking conditions include temperature in the range from substantially 350° C. to substantially 500° C., pressure in the range from substantially 2 MPa to substantially 7 MPa and liquid space velocity from substantially 0.5 $h^{-1}$ to substantially 10.0 $h^{-1}$.

6. A process as claimed in claim 5 in which the temperature is between 400° C. to 460° C., the pressure is between 2.5 MPa and 6 MPa, and the space velocity is between 0.8 $h^{-1}$ and 7.0 $h^{-1}$.

7. A process as claimed in claim 1 in which the gaseous stream separated from the hydrocracked stream is desulphurized then reacted with steam in a steam reforming operation to form the hydrogen-rich gaseous stream for reaction with said hydrogen donor precursor stream.

8. A process as claimed in claim 1 in which the hydrogen donor precursor stream is a fraction distilled from the liquid hydrocracked stream and boils from substantially 200° C. to substantially 330° C.

9. A process as claimed in claim 1 in which the hydrogenated hydrogen donor material from step (e) is fractionally distilled to separate therefrom material boiling below substantially 220° C. and material boiling above substantially 295° C., before being recycled to step (b).

10. A process as claimed in claim 1 in which fractions distilled from the residuum are combined with the fractions of the liquid hydrocracked stream other than the hydrogen donor precursor stream to form an upgraded oil of lower viscosity and specific gravity than the original hydrocarbonaceous oil.

11. A process as claimed in claim 1 in which at least one fraction distilled from the residuum is individually combined with the corresponding boiling range fraction distilled from the liquid hydrocracked stream, and the resulting material is catalytically hydrogenated.

12. In a process for the upgrading of heavy, viscous hydrocarbonaceous oils comprising fractionally distilling said hydrocarbonaceous oil to produce at least one distilled fraction and a residuum without substantially cracking said hydrocarbonaceous oil, contacting said residuum with a liquid hydrogen donor material stream to produce a hydrocracked stream and separating said hydrocracked stream into a gaseous stream and a liquid hydrocracked stream, the improvement comprising:

(a) fractionally distilling said liquid hydrocracked stream to separate from higher and lower boiling fractions a hydrogen donor precursor stream boiling above a temperature from substantially 180° C. to substantially 200° C. and below a temperature from substantially 330° C. to substantially 350° C., (b) catalytically reacting said hydrogen donor precursor stream with a hydrogen-rich gaseous stream to produce a hydrogenated hydrogen donor material, and (c) recycling at least part of said hydrogenated hydrogen donor material as the material which constitutes the entire length hydrogen donor material stream to contact said residuum.

13. In a process for the upgrading of heavy, viscous hydrocarbonaceous oils comprising fractionally distilling said hydrocarbonaceous oil to produce at least one distilled fraction and a residuum without substantially cracking said hydrocarbonaceous oil, contacting said residuum with a liquid hydrogen donor material stream to produce a hydrocracked stream and separating said hydrocracked stream into a gaseous stream and a liquid hydrocracked stream, the improvement comprising:

(a) fractionally distilling said liquid hydrocracked stream to separate from higher and lower boiling fractions a hydrogen donor precursor stream boiling above a temperature from substantially 180° C. to substantially 200° C. and below a temperature from substantially 330° C. to substantially 350° C., (b) catalytically reacting said hydrogen donor precursor stream with a hydrogen-rich gaseous stream to produce a hydrogenated hydrogen donor material, (c) fractionally distilling said hydrogenated hydrogen donor material to separate from higher and lower boiling fractions an optimized hydrogenated hydrogen donor material boiling above a temperature of substantially 220° C. and below a temperature of substantially 295° C., and (d) recycling said optimized hydrogenated hydrogen donor material as the material which constitutes the entire liquid hydrogen donor material stream to contact said residuum.

* * * * *